US006171657B1

(12) United States Patent
Perdikaris

(10) Patent No.: US 6,171,657 B1
(45) **Date of Patent: *Jan. 9, 2001**

(54) METHOD OF COATING YANKEE DRYERS AGAINST WEAR

(75) Inventor: Chris Perdikaris, Norwalk, CA (US)

(73) Assignee: Bender Machine, Inc., Vernon, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/574,042

(22) Filed: Dec. 18, 1995

(51) Int. Cl.[7] ..... C23C 4/06

(52) U.S. Cl. ..... 427/456; 427/383.7

(58) Field of Search ..... 427/456, 383.1, 427/452, 383.7, 422, 425, 427

(56) References Cited

U.S. PATENT DOCUMENTS

| | | | | |
|---|---|---|---|---|
| 4,064,608 | * | 12/1977 | Jaeger | 29/132 |
| 4,160,048 | * | 7/1979 | Jaeger | 427/142 |
| 4,389,251 | * | 6/1983 | Simm et al. | 75/255 |
| 4,822,415 | * | 4/1989 | Dorfman et al. | 75/251 |
| 5,292,382 | * | 3/1994 | Longo | 148/320 |

* cited by examiner

*Primary Examiner*—Shrive Beck
*Assistant Examiner*—Bret Chen
(74) *Attorney, Agent, or Firm*—Louis J. Bachand; Jun Lee

(57) ABSTRACT

Method of improving the tribological and erosive wear resistance of yankee dryer drums including coating the drum with an iron alloy containing from about 20 to about 47 weight per cent chromium, about 2.5 to about 6.5 weight per cent boron, about 1.7 to about 2.7 weight per cent silicon, and less than about 8 weight per cent molybdenum. The coated yankee dryer drum is long wearing based on the hardness of the coating and smooth wearing as the coating has a consistent composition through its depth at the outset and over time.

26 Claims, No Drawings

METHOD OF COATING YANKEE DRYERS AGAINST WEAR

TECHNICAL FIELD

This invention relates to methods of coating yankee dryers to protect them against wear and to reduce paper production problems associated with yankee dryer wear. More particularly, the invention relates to obtaining smooth-wearing coatings for yankee dryers, the drum-like apparatus used to dry paper forming webs. The present invention yankee dryer coating combines great hardness for durability with excellent ductility against coating failure from fatigue as the dryer expands and contracts through cycles of temperature. More particularly, the invention is concerned with methods for providing yankee dryer drums with a coating which allows for longer runs of paper products with higher uniformity and fewer flaws, while requiring reduced downtime.

BACKGROUND OF THE INVENTION

Yankee dryers comprise large-scale drums, typically formed of cast iron, which are internally heated with pressurized steam and used to dry paper webs at the end of a paper-making line. These drums which expand and contract with the steam heat carry the moisture-containing paper web partway around their circumference to a take-off point marked by a blade which acts to separate the paper web from the drum for collection on a take-up roll. Yankee dryer drums are subject to wear from friction, i.e. tribological wear, and from chemical wear or erosion caused by chemical action, e.g. by chloride, fluoride and sulfite ion interactions with the drum surface as a concomitant of papermaking operations. Surface imperfections such as surface roughness then develop and this causes the separation blade to wear prematurely and irregularly and the paper quality is adversely affected. To avoid this, the yankee dryer drums must be periodically reground and repolished as surface imperfections become significant. Resurfacing of the dryer by grinding and polishing is costly in downtime, lost paper production, and in charges for overhaul of the dryer drum surface.

SUMMARY OF THE INVENTION

A successful coating for a yankee dryer will be hard so as to wear a long time, and resistant to erosive wear from chemical action over the long wearing period. Since there is continual wear, the capacity of the coating to maintain a high degree of uniformity of composition through the coating thickness, rather than have the coating composition vary with depth, becomes paramount. Loss of even one element from the coating alloy, for example molybdenum loss from a molybdenum-nickel-chromium coating containing too high levels of molybdenum, or a substantial decrease in its presence, as the coating wears, may allow chemically-induced erosion as wear progresses albeit not at the outset. As noted above, erosion and tribological wear will cause development of surface imperfections, manifested generally as roughness, loss of take-off blade efficiency, and deterioration in productivity.

It is accordingly an object of the invention to provide a method of coating yankee dryers with a hard but ductile coating composition and which provides a uniform coating composition through its effective depth so that wear resistance is substantially constant in progressing through the coating, to provide novel methods of papermaking with a yankee dryer, and to provide yankee dryer drums with a novel tribological and erosion wear resistant coating.

These and other objects of the invention to become apparent hereinafter are realized in the method of protectively coating against tribological and erosive wear a yankee dryer drum to be used for carrying a paper forming web in drying relation, including interposing between the surface of the yankee dryer drum and the paper forming web a coating comprising an iron alloy containing from about 20 to about 47 weight per cent chromium, about 2.5 to 6.5 weight per cent boron, about 1.7 to 2.7 weight per cent silicon, and less than 8 weight per cent molybdenum. In particular aspects the invention method includes selecting as the iron alloy an alloy containing no molybdenum, thermal, including arc spraying the alloy onto the dryer drum, selecting as the alloy an iron alloy having the composition:

| Component | Weight Percent |
|---|---|
| Boron | 2.5–6.5 |
| Carbon | 0.0–0.15 |
| Chromium | 20–47 |
| Copper | 0–2.5 |
| Iron | 45–60 |
| Manganese | 0.0–1.5 |
| Molybdenum | 0.0–8.0 |
| Nickel | 0.0–25 |
| Phosphorus | 0.035 |
| Silicon | 1.7–2.7 |
| Sulfur | 0.025 |
| Titanium | 0.0–0.3 |

and selecting as the alloy an iron alloy comprising about 55 weight per cent iron and about 20–45 weight per cent chromium and having a Rockwell C hardness of about 55 to 70.

The invention further contemplates the method of forming a coating on a yankee dryer drum against tribological and erosive wear by paper-forming webs passing over the dryer drum in drying relation, including spraying an iron alloy onto the web-contacting surfaces of the dryer drum, the iron containing about 20 to about 47 weight per cent chromium, about 2.5 to 6.5 weight per cent boron, about 1.7 to 2.7 weight per cent silicon, and less than 8 weight per cent molybdenum, and preferably comprising about 55 weight per cent iron and 20–45 weight per cent chromium.

In a further aspect of the invention, there is provided the method of papermaking with a yankee dryer, including passing a paper-forming web over a yankee dryer drum in drying relation, and interposing between the paper-making web and the dryer drum a tribological and erosive wear limiting coating consisting essentially of an iron alloy containing about 20 to about 47 weight per cent chromium, about 2.5 to 6.5 weight per cent boron, about 1.7 to 2.7 weight per cent silicon, and less than 8 weight per cent molybdenum, and preferably comprising about 55 weight per cent iron and 20–45 weight per cent chromium. In this embodiment as in previous embodiments, typically, the method further includes selecting as the iron alloy in the interposed coating an iron alloy containing less than 8 weight per cent of, and preferably free of, molybdenum and containing about 55 weight per cent iron and 20–45 weight per cent chromium.

The invention further provides a coated yankee dryer comprising a drum, the drum having a tribological and erosive wear limiting coating comprising an iron alloy containing about 20 to about 47 weight per cent chromium, about 2.5 to 6.5 weight per cent boron, about 1.7 to 2.7 weight per cent silicon, and less than 8 weight per cent molybdenum, e.g the iron alloy has the composition:

| Component | Weight Percent |
|---|---|
| Boron | 2.5–6.5 |
| Carbon | 0.0–0.15 |
| Chromium | 20–47 |
| Copper | 0–2.5 |
| Iron | 45–60 |
| Manganese | 0.0–1.5 |
| Molybdenum | 0.0–8.0 |
| Nickel | 0.0–25 |
| Phosphorus | 0.035 |
| Silicon | 1.7–2.7 |
| Sulfur | 0.025 |
| Titanium | 0.0–0.3 |

In this and like embodiments, typically, the drum comprises iron, the coating has a thickness of 20 to 60 mils, the coating has less than about 5% porosity, the coating has a Rockwell C hardness between about 55 and 70, the coating is free of molybdenum, and consists essentially of about 55 weight per cent iron and about 20–45 weight per cent chromium, or the coating has a thickness of 30 to 50 mils, and the coating is thermally sprayed onto the drum.

DESCRIPTION OF THE PREFERRED EMBODIMENTS

The invention is applicable to either new or refurbished yankee dryers, In either case the yankee dryer drum is trued and set in a jig for application of the coating onto the typical cast iron drum body. The drum body may be rotated in front of a thermal spray apparatus, such as an arc spray apparatus in which the coating metal is supplied in wire form, melted in an electric arc, and blown onto the drum surface. Standard conditions for an arc spray or other thermal spray process appropriate to the powder or wire feed being used. Other coating processes may be used. Coating build-ups of 30 to 50 mils are usefully employed. Porosity in the coating should be limited to 5% or less as determined by inspection against a benchmark that may be established by photographing a cross-section of the coating, magnifying the image, e.g. by 500 times, staining the void portions, and measuring the stained area with an image analyzer. Cf. U.S Pat. No. 4,912,835 to Harada.

The present method uses an iron alloy, i.e. an alloy in which iron is the largest single component although not necessarily constituting more than 50 weight per cent of the total alloy. The quantity of molybdenum is limited to less than 8 weight per cent so as to avoid deterioration of the alloy through molybdenum loss during use. It has been found that in typical yankee dryer application conditions molybdenum if present in higher concentrations, e.g. 9 weight per cent and more, tends to migrate from an iron-nickel coating, changing the coating composition over time and adversely affecting tribological and erosive wear resistance. Accordingly, an iron alloy which affords high hardness with reduced use of molybdenum, e.g. without the use of substantial or even any amounts of molybdenum is preferred herein. A particularly preferred alloy is an iron alloy containing a high proportion of chromium, such as a 55 weight per cent iron, and 20–45 weight per cent chromium alloy, having the detailed composition indicated above and available as a coating composition from Bender Machine under the trade designation TS-1000. This alloy is amorphous and hard and surprisingly ductile. Ductility is an important quality in a yankee dryer coating since in use the dryer drum is heated to elevated temperatures under internal pressurized steam and bows out locally under centrifugal forces as well as internal pressures. Failure to accommodate this flexing of the drum wall will cause the coating to crack, become rough or even delaminate. Other alloys of similar composition and properties can also be used, especially where they are readily applied by common techniques.

The yankee dryer drum is coated as indicated and installed or reinstalled in the papermaking line where it is used to carry the papermaking web around a portion of its circumference while heating the web to substantial dryness to be taken off at the blade device for rolling on a take-up roll. It is in the increased longevity of the blade and the consequent reduced downtime that the present yankee dryer drums prove their value. While not wishing to be bound to a particular theory, it is believed that the invention coating maintains its composition substantially constant through the coating depth in contrast to other coating materials which change in composition through depth, sometimes through loss of an element such as molybdenum. Because of the invention constancy of composition, wear of the coating does not adversely affect the coating properties. Resistance to tribological wear remains effective; resistance to chemical wear or erosive wear also remains effective over time. Continuing effective wear resistance means that the coating surface will not become rough as wear progresses or because of compositional changes. A lack of increase in surface roughness means that the blade at the take-off locus does not wear unduly or irregularly. As the invention coating wears, it wears smoothly. The result is better productivity, less downtime, and less unsatisfactory product produced. In its papermaking production aspects, the invention provides a coating interposed between the papermaking web and the yankee dryer drum surface which coating enables the just-described advantages. And a coated yankee dryer drum affording these same advantages is further provided. The foregoing objects of the invention are thus met.

What is claimed is:

1. A method of protectively coating against tribological and erosive wear a Yankee dryer drum useful in papermaking for drying a paper forming web, including interposing a drum coating on the surface of the Yankee dryer drum to be under said paper forming web, said drum coating comprising a thermally sprayed iron alloy composition selected from a set of possible compositions containing from about 20 to about 47 weight per cent chromium, about 2.5 to about 6.5 weight per cent boron, 0.0 to about 0.15 weight per cent carbon, about 1.7 to about 2.7 weight per cent silicon, less than about 8 weight per cent molybdenum, and the balance iron, said selected iron alloy composition establishing in said drum coating a characteristic Rockwell C hardness of approximately 55–70;

whereby erosive wear of said drum dryer surface coated with said composition caused by chemical action of chloride, fluoride, and sulfite ions during papermaking is resisted.

2. The method according to claim 1, including also selecting as said iron alloy an iron alloy containing from about 20 to about 45 weight per cent chromium and no molybdenum.

3. The method according to claim 1, including also selecting as said iron alloy an iron alloy containing:

| Component | Weight Percent |
|---|---|
| Boron | 2.5–6.5 |
| Carbon | 0.0–0.15 |
| Chromium | 20–47 |
| Copper | 0–2.5 |
| Iron | Balance |
| Manganese | 0.0–1.5 |
| Molybdenum | 0.0–8 |
| Nickel | 0.0–25 |
| Phosphorus | 0.035 |
| Silicon | 1.7–2.7 |
| Sulfur | 0.025 |
| Titanium | 0.0–0.3. |

4. The method according to claim 3 including also selecting as said iron alloy an iron alloy containing about 20–45 weight per cent chromium.

5. A method of forming a coating on a Yankee dryer drum against tribological and erosive wear by paper-forming webs being dried in contact with said dryer drum, including thermal spraying an iron alloy coating composition onto web-contacting surfaces of said dryer drum, said iron alloy coating composition containing from about 20 to about 47 weight per cent chromium, about 2.5 to about 6.5 weight per cent boron, 0.0 to 0.15 weight per cent carbon, about 1.7 to about 2.7 weight per cent silicon, less than about 8 weight per cent molybdenum, and the balance iron, said composition establishing in said drum coating a Rockwell C hardness of approximately 55–70;

whereby erosive wear of said drum dryer surface caused by chemical action of chloride, fluoride, and sulfite ions during papermaking is resisted.

6. The method according to claim 5, including also selecting as said iron alloy coating composition an iron alloy containing about 20–45 weight per cent chromium, and no molybdenum.

7. A Yankee dryer comprising a drum, said drum having a tribological and erosive wear coating formed by the method of claim 6.

8. A Yankee dryer comprising a drum, said drum having a tribological and erosive wear coating formed by the method of claim 5.

9. The Yankee dryer according to claim 8, in which said drum comprises iron.

10. The Yankee dryer according to claim 9, in which said coating has a thickness of 20 to 60 mils.

11. The Yankee dryer according to claim 10, in which said coating has less than about 5% porosity.

12. The Yankee dryer according to claim 11, in which said coating has a thickness of 30 to 50 mils.

13. The Yankee dryer according to claim 12, in which said coating contains no molybdenum.

14. A method of papermaking with a Yankee dryer, including passing a paper-forming web to a Yankee dryer drum, and passing said paper-forming web over said Yankee dryer drum, said Yankee dryer drum having a drum coating comprising a thermally sprayed iron alloy coating composition containing from about 20 to about 47 weight per cent chromium, about 2.5 to about 6.5 weight per cent boron, 0.0 to 0.15 weight per cent carbon, about 1.7 to about 2.7 weight per cent silicon, less than about 8 weight per cent molybdenum, and the balance iron, said composition establishing in said drum coating a Rockwell C hardness of approximately 55–70;

whereby erosive wear of said drum dryer surface caused by chemical action of chloride, fluoride, and sulfite ions during papermaking is resisted.

15. The method of papermaking with a Yankee dryer drum according to claim 14, including also selecting as said iron alloy drum coating composition an iron alloy containing about 20–45 weight per cent chromium, and no molybdenum.

16. A Yankee dryer comprising a drum, said drum having a tribological and erosive wear coating comprising a thermally sprayed iron alloy coating composition containing from about 20 to about 47 weight per cent chromium, about 2.5 to about 6.5 weight per cent boron, 0.0 to 0.15 weight per cent carbon, about 1.7 to about 2.7 weight per cent silicon, less than about 8 weight per cent molybdenum, and the balance iron, said composition establishing in said drum coating a Rockwell C hardness of approximately 55–70;

whereby erosive wear of said drum dryer surface caused by chemical action of chloride, fluoride, and sulfite ions during papermaking is resisted.

17. The Yankee dryer according to claim 16, in which said iron alloy coating composition contains:

| Component | Weight Percent |
|---|---|
| Boron | 2.5–6.5 |
| Carbon | 0.0–0.15 |
| Chromium | 20–47 |
| Copper | 0–2.5 |
| Iron | Balance |
| Manganese | 0.0–1.5 |
| Molybdenum | 0.0–8 |
| Nickel | 0.0–25 |
| Phosphorus | 0.035 |
| Silicon | 1.7–2.7 |
| Sulfur | 0.025 |
| Titanium | 0.0–0.3. |

18. The Yankee dryer according to claim 16, in which said drum comprises iron.

19. The Yankee dryer according to claim 18, in which said coating has a thickness of 20 to 60 mils.

20. The Yankee dryer according to claim 16, in which said coating has less than about 5% porosity.

21. The Yankee dryer according to claim 16, in which said iron alloy coating contains about 20–45 weight per cent chromium and no molybdenum.

22. The Yankee dryer according to claim 21, in which said coating has a thickness of 30 to 50 mils.

23. The Yankee dryer according to claim 22, in which said coating has less than about 5% porosity.

24. A method of protectively coating against tribological and erosive wear a Yankee dryer drum useful in papermaking for drying a paper forming web, including interposing a drum coating on the surface of the Yankee dryer drum to be under said paper forming web, comprising thermally spraying an iron alloy composition to form said drum coating, said iron alloy composition containing greater than 30 to about 47 weight per cent chromium, greater than 3.0 to about 6.5 weight per cent boron, 0.0 to about 0.15 weight per cent carbon, about 1.7 to about 2.7 weight per cent silicon, less than about 8 weight per cent molybdenum, and the balance iron, said composition substantially establishing in said drum coating a characteristic Rockwell C hardness of approximately 55 to 70;

whereby erosive wear of said drum dryer surface coated with said composition caused by chemical action of chloride, fluoride, and sulfite ions during papermaking is resisted.

25. A method of protectively coating against tribological and erosive wear a Yankee dryer drum useful in papermaking for drying a paper forming web, including interposing a drum coating on the surface of the Yankee dryer drum to be under said paper forming web, comprising thermally spraying an iron alloy composition to form said drum coating, said iron alloy composition containing greater than 25 to about 47 weight per cent chromium, greater than 5.0 to about 6.5 weight per cent boron, 0.0 to about 0.15 weight per cent carbon, about 1.7 to about 2.7 weight per cent silicon, less than about 8 weight per cent molybdenum, and the balance iron, said composition substantially establishing in said drum coating a characteristic Rockwell C hardness of approximately 55 to 70;

whereby erosive wear of said drum dryer surface coated with said composition caused by chemical action of chloride, fluoride, and sulfite ions during papermaking is resisted.

26. A method of protectively coating against tribological and erosive wear a Yankee dryer drum for drying a paper forming web during papermaking comprising the steps of:

(a) interposing a drum coating on the surface of the Yankee dryer drum beneath said paper forming web;

(b) providing an iron alloy composition containing chromium, boron, and carbon in sufficiently proportional manner to include: from about 20 to about 47 weight per cent chromium, about 2.5 to about 6.5 weight per cent boron, 0.0 to about 0.15 weight per cent carbon, about 1.7 to about 2.7 weight per cent silicon, less than about 8 weight per cent molybdenum, and the balance iron;

(c) forming at least a portion of said drum coating by thermally spraying said iron alloy composition on said dryer drum surface;

(d) establishing a characteristic Rockwell C hardness parameter value of approximately 55 to 70 for said drum coating;

whereby erosive wear of said drum dryer surface having said drum coating due to the chemical action of chloride, fluoride, and sulfite ions during papermaking is resisted.

* * * * *